United States Patent [19]

Krenz

[11] 4,395,151

[45] Jul. 26, 1983

[54] PRINT HEAD DRIVE BELT TENSIONING MEANS AND METHOD FOR LINE PRINTER

[75] Inventor: Horst M. Krenz, St. Joseph, Mich.

[73] Assignee: Zenith Radio Corporation, Glenview, Ill.

[21] Appl. No.: 317,663

[22] Filed: Nov. 2, 1981

[51] Int. Cl.[3] ..... B41J 19/14

[52] U.S. Cl. ..... 400/320; 400/322; 400/335; 474/117

[58] Field of Search ..... 400/320, 322, 335; 101/111; 474/115, 117

[56] References Cited

U.S. PATENT DOCUMENTS 1,597,043 8/1926 Belger ..... 474/117 X 4,189,244 2/1980 Harrison ..... 400/320 X

FOREIGN PATENT DOCUMENTS 56-30881 3/1981 Japan ..... 400/322

*Primary Examiner*—Edgar S. Burr
*Assistant Examiner*—David A. Wiecking

[57] ABSTRACT

Means are disclosed for use in a line printer having a print head for traversing between a first side frame and a second side frame. The print head is driven in its traverse by a flexible belt close-looped between an idler pulley and a driven pulley. A predetermined tension of the belt is provided and maintained by the means and method according to the invention.

2 Claims, 5 Drawing Figures

PRINT HEAD DRIVE BELT TENSIONING MEANS AND METHOD FOR LINE PRINTER

BACKGROUND OF THE INVENTION

This invention relates to computer printers, and is particularly concerned with improved means for enhancing the performance, reliability and maintainability of high-speed line printers.

Line printers are peripheral to computer systems, providing primarily for alphanumeric "hard copy" output. Printing speed is usually very high, ranging from 130 to 280 lines per minute, for example. This high speed is made possible largely by the bidirectional movement of the print head.

Line printers, once turned on, are expected to operate for long periods unattended, and with high reliability. The print medium, such as the fan-fold, edge-punched continuous form, is usually loaded in large quantities. Any necessary adjustment such as for print medium thickness, drive belt tension or print head parallelism must be such as to be accomplished quickly and easily, and without the need for special tools or skills.

OBJECTS OF THE INVENTION

It is a general object of this invention to enhance performance, reliability and maintainability of line printers.

It is a less general object of this invention to simplify maintenance of line printers.

It is a more specific object of the invention to provide means and method for maintaining a predetermined tension on a print head drive belt without continual spring pressure on the belt.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
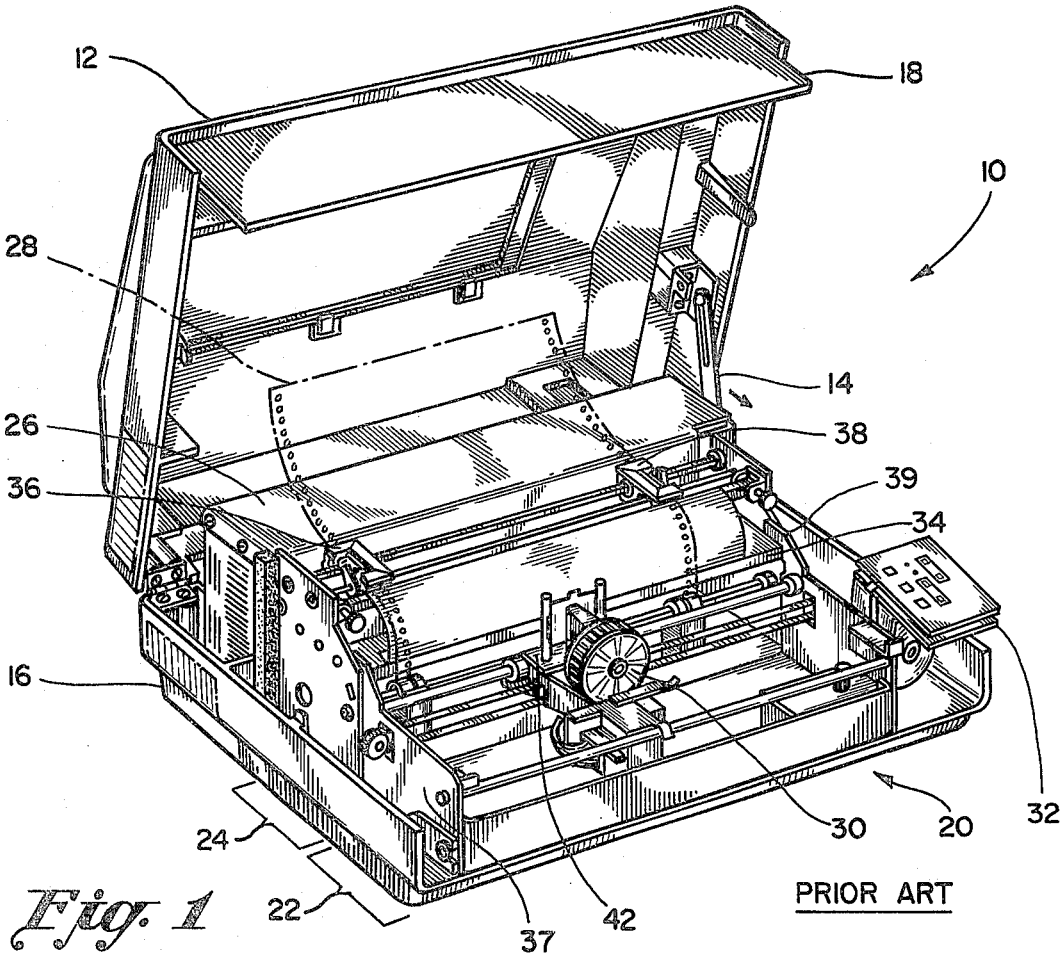
Fig. 1 PRIOR ART
FIG. 1 is a view in perspective depicting a line printer with the cover open to show operating components.

A high-speed line printer 10 of a type to which the present invention has application is shown by FIG. 1. Cover 12 is depicted as being raised and held in an open position by bracket 14, which has a detented section for locking cover 12 in the open position.

The component parts of the line printer 10 are depicted as being installed in a base cabinet 16 which mates with cover 12 upon closure of cover 12. Cover 12 will be noted as having an overhanging panel 18 which enters a recess 20 at the front of base cabinet 16 when the cover is closed.

Line printer 10 consists of three basic assemblies—a print drive unit 22 and a paper drive unit 24, as indicated by the brackets, and an electronic circuit assembly 26 shown as being covered. The print drive unit 22 and paper drive unit 24 act in concert to print characters on a print medium 28, usually paper, that is drawn past the print head 30 of the print drive unit 22. Print drive unit 22 is shown in greater detail in FIG. 2.

The electronic circuit assembly 26 contains components for interfacing with a computer (not shown) to which the line printer 10 is peripheral. A multi-conductor electrical cable (not shown) links the line printer 10 and the computer, carrying the computer's instruction to line printer 10, and information about the line printer's status back to the computer. The primary component of the electronic circuit assembly 26 is a microprocessor which receives and interprets the instructions from the computer, controls the print head and paper advance motors, tells the computer when to send more information, and controls the flow of information inside the line printer 10. Other components in the line printer 10 are directed by the microprocessor to switch the internal voltages and currents for rapid, precise control of the print head drive motor, paper advance motor, and ribbon advance motor. The controls and indicators which govern the operation of the line printer 10 are contained on control panel 32.

The print medium 28, noted as normally being paper, is supplied to the line printer 10 from a fan-fold or from a continuous roll in which individual sheets are distinguished by perforations lateral to the length of the paper and adjacent to the edges of the paper. The paper is normally stored in a dispenser, usually in a cabinet or stand which supports the line printer 10. Line printer 10 has an upper paper drive mechanism comprising a pair of tractor members 36 and 38, each having a toothed wheel for engaging the perforations in the print medium 28 that extend along each edge, as depicted. A second paper drive mechanism similar to the one described is located beneath the area of the platen 34, but is not shown in FIG. 1.

Figure 2:
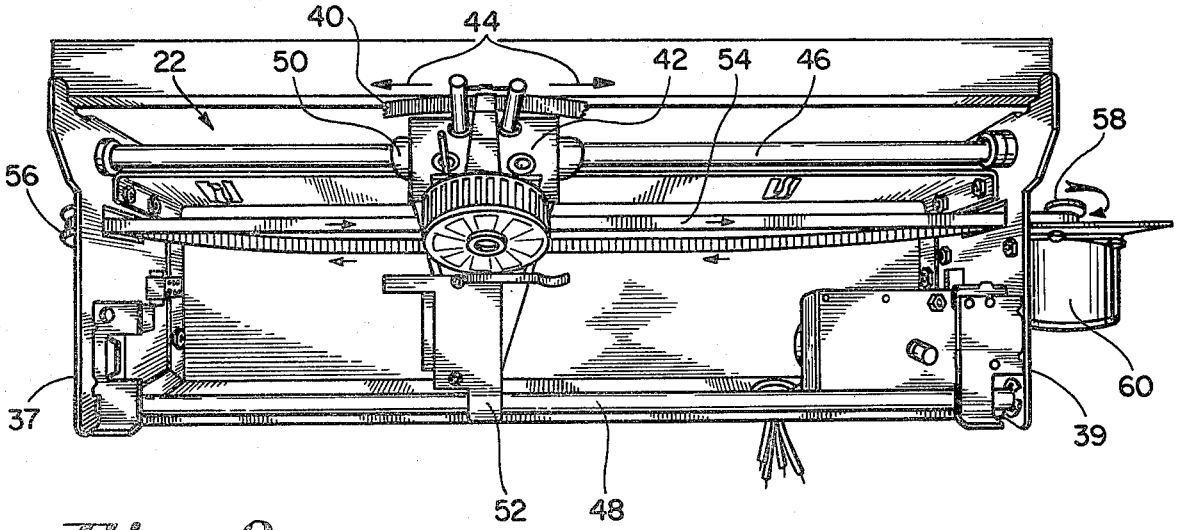
Fig. 2 PRIOR ART
FIG. 2 is a top view in perspective of an operating component shown by FIG. 1.

As the print medium 28 moves upwardly a line at a time, characters are printed by the print head 30, which traverses between a first side frame 37 and a second side frame 39 of print drive unit 22. The print medium 28 moves upwardly between an inked ribbon 40, a section of which is indicated in FIG. 2, and the platen 34.

Print head 30 is a standard impact printer which includes a vertically aligned array of print wires (not shown). Each wire of the array is selectively electromagnetically activated to advance toward platen 34, impacting the print medium 38 through the ribbon 40 to produce a dot of ink on the print medium. The selectively activated wires produce a matrix of dots representing a desired character; for example, the letter A or the numeral 2.

The print head 30 is carried by a print head carriage assembly 42. The carriage assembly 42 moves parallel to the platen 34 in the directions indicated by the associated arrows 44. Carriage assembly 42 is indicated as riding upon a pair of parallel slider bars 46 and 48 with moving contact with bars 46 and 48 made by slider means 50 and 52, respectively.

Print head 30 is driven in its traverse by a flexible belt 54 close-looped around an idler pulley 56 adjacent and external to the first side frame 37, and a driven pulley 58 adjacent and external to the second side frame 39. As driven pulley 58 is rotated in either a clockwise or counterclockwise direction by a print head drive motor 60, for example, guide assembly 42 and print head 30 traverse parallel to platen 34 for printing characters on print medium 28. Driven pulley 58 is indicatd as being mounted adjacent and external to second side frame 39. Flexible belt 54 is shown as being a "synchronous" belt; that is, one having cogs for engagement with compatible synchronous cogged pulleys 56 and 58.

It is essential that the belt 54 be maintained at the proper tension for proper operation. A belt that is too tight can cause excess wear on the shaft bearings of motor 58, and upon the bearings supporting the shaft of idler pulley 56. A belt that is too loose—a condition which may occur as a result of wear and stretching through use—can result in erratic movement of the print head 30 with the result that steps are missed in the printing. Also, loose belt 54 can cause horizontal misalignment of print lines.

Figure 3:
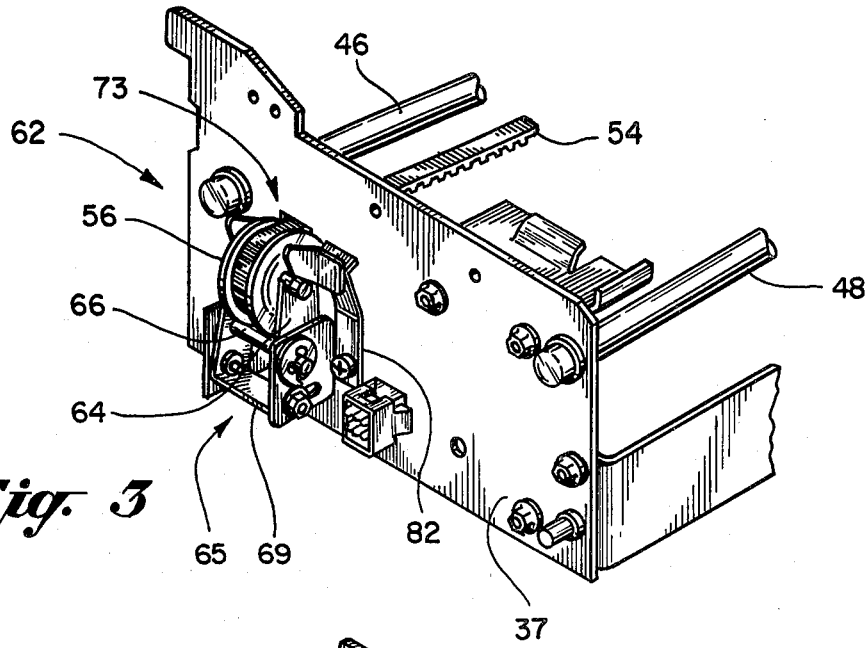
FIG. 3 is a view in perspective of a section of the printer depicted in FIG. 1 showing details of the belt-tensioning means according to the invention.
Figure 4:
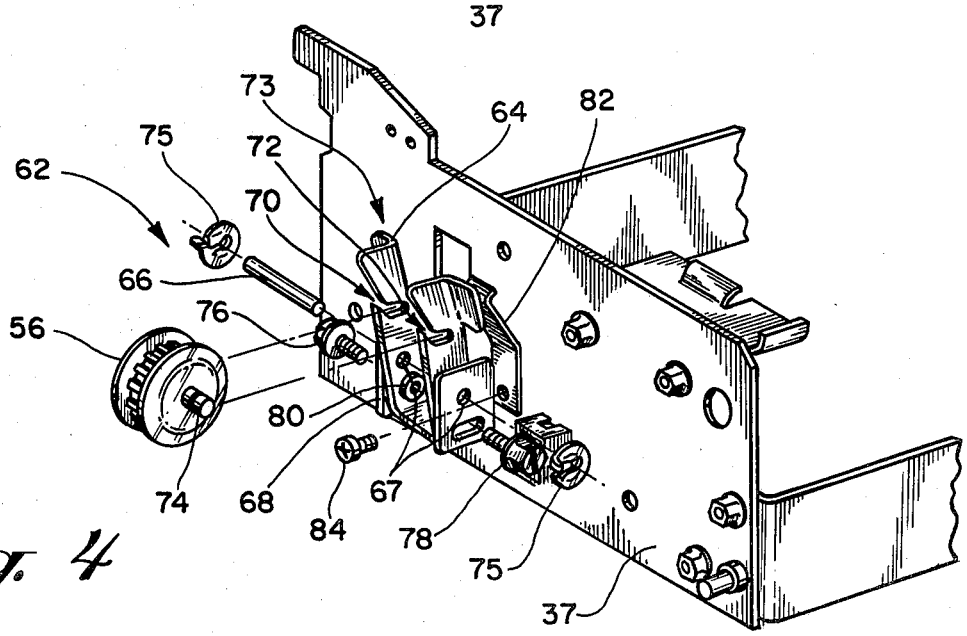
FIG. 4 is an exploded view in perspective of the components of the means according to the invention shown by FIG. 3; and, FIG. 5 is a detail view in perspective of a spring component depicted in FIGS. 3 and 4.

FIGS. 3 and 4 depict, respectively, a preferred embodiment of the invention as assembled and as exploded. The figures will be recognized as being detail views of the external area of first side frame 37 of print drive unit 22. The improved means and method according to the preferred embodiment of the invention for providing and maintaining a predetermined tension of belt 54 comprise the following.

Idler pulley support means 62 is depicted as comprising a U-shaped bracket means 64 for supporting idler pulley 56. Bracket means 64 includes pivot means 65 for pivotally coupling bracket means 64 to first side frame 37. Pivot means is indicated as being adjacent to the closed end 69 of the U-shaped bracket means 64. Pivot means 65 includes a pivot shaft 66 for pivoting bracket means 64; shaft 66 is indicated as being supported by its passage through aligned holes 67 in bracket means 64 and a pulley support bracket 68 attached to first side frame 37, as indicated.

Bracket means 64 includes inwardly and downwardly sloping slot means 70 and 72 in each leg of U-shaped bracket means 64, and adjacent to the open end 73 of bracket means 64. The slot means 70 and 72 provide for retentatively receiving the axle 74 of idler pulley 56. Axle 74 is indicated as being retained by two grip rings 75.

Clamping means according to the invention provide for selectively freeing or fixing the pivot action of bracket means 64. The clamping means are indicated as consisting of screw means 76 and 78, shown as being slotted, hex-head machine screws. The threads of screw means 76 and 78 are received by female threaded members attached to bracket 64; one such threaded member 80 is visible in FIG. 4. Rotation of screw means 76 and 78 in a clockwise direction provides for clamping and fixing U-shaped bracket means 64 to pulley support bracket 68, thus fixing the pivot action of bracket means 64. Rotation of screw means 76 and 78 in a counterclockwise direction frees the pivot action.

Spring means 82 exerts belt-tightening pressure against U-shaped bracket means 64 when bracket means 64 is made free to pivot by the counterclockwise rotation of screw means 76 and 78, hence providing a predetermined pressure on belt 54.

Figure 5:
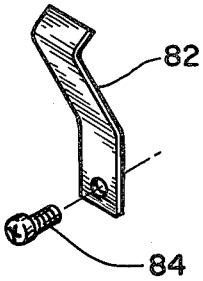

The configuration of spring 82 is shown in greater detail in FIG. 5. The spring 82 is indicated as being attached to first side frame 37 by a machine screw 34. The outward pressure against bracket means 64 provides a predetermined tightening pressure on belt 54 of, preferably, about 5 inch-pounds.

The improved means according to the invention is such that when the clamping means is set to free the pivot action of bracket means 64, pulley 56 pivots in response to the belt-tightening pressure of spring 82. When pivot means 65 is thereafter fixed by the clamping means, the predetermined tension of belt 54 is maintained without an undesired continued pressure on belt 54 by spring 82. Such continual pressure would result in erratic performance of the printing head. This continual pressure is, in effect, actually "discontinuous" in that it would cause erratic print head performance due to the flexing of the spring and of the belt in response to rapid acceleration and deceleration of the print head as it changes direction.

The method according to the invention that provides for simple and quick setting up of a predetermined belt tension, entails the providing of an idler pulley support means in the form of a U-shaped bracket 64, and pivotally coupling the bracket to the first side frame 37. The coupling is located adjacent to the closed end 69 of bracket 64. Inwardly and downwardly sloping slot means 70 and 72 are provided in each leg of U-shaped bracket 64, adjacent to the open end of bracket 64. The slot means 70 and 72 provide for retentatively receiving the axle 74 of idler pulley 56. Clamping means are provided for selectively freeing the pivot action of the bracket means 64. Spring means 82 are provided for exerting belt-tightening pressure against the bracket means 64 when bracket means 64 is free to pivot for providing predetermined tension on belt 54. Freeing the pivot action of bracket means 64 by unclamping the clamping means provides for predetermined pressure on the belt 54, and fixing the pivot action of bracket means 64 maintains the predetermined tension of belt 54.

While a particular embodiment of the invention has been shown and described, it will be obvious to those skilled in the art that changes and modifications may be made without departing from the invention in its broader aspects, and therefore, the air of the appended claims is to cover all such changes and modifications which fall within the true spirit and scope of the invention.

We claim:

1. For use in a line printer having a print head for traversing between a first side frame and a second side frame of said printer, said print head being driven in its traverse by a flexible synchronous belt close-looped around a synchronous idler pulley rotatably mounted on an axle external to said first side frame and a motor-driven synchronous pulley external to said second side frame, improved means for providing and maintaining a predetermined tension on said belt comprising:

U-shaped bracket means for supporting said idler pulley, said bracket means including pivot means adjacent to the closed end of said U-shaped bracket means for pivotally coupling said bracket means to said first side frame, said bracket means including inwardly and downwardly sloping slot means in each leg of said bracket means and adjacent to the open end of said U-shaped bracket means for retentatively receiving said axle of said idler pulley;

clamping means consisting of screw means for selectively freeing or fixing the pivot action of said bracket means;

spring means for exerting belt-tightening pressure against said U-shaped bracket means when said bracket means is free to pivot for providing a predetermined pressure on said belt;

such that when said clamping means is set to free the pivot action of said U-shaped bracket means, said idler pulley support means and said pulley pivot in response to said belt-tightening pressure of said spring means, and when said pivot means is thereafter fixed by said clamping means, said predetermined tension on said belt is maintained without an undesired continual pressure on said belt by said spring means.

2. For use in the maintenance of a line printer having a print head for traversing between a first side frame and a second side frame of said printer, said print head being driven in its traverse by a flexible synchronous belt close-looped around a synchronous idler pulley rotatably mounted on an axle external to said first side frame and a motor-driven synchronous pulley external to said second side frame, an improved method for providing and maintaining a predetermined tension of said belt comprising:

providing U-shaped bracket means for supporting said idler pulley;

pivotally coupling said U-shaped bracket means externally to said first side frame, and locating said coupling adjacent to the closed end of said U-shaped bracket means;

providing inwardly and downwardly sloping slot means in each leg of said U-shaped bracket means and adjacent to the open end of said U-shaped bracket means for retentatively receiving said axle of said idler pulley;

providing clamping means consisting of screw means for selectively freeing or fixing the pivot action of said U-shaped bracket means;

providing spring means for exerting belt-tightening pressure against said U-shaped bracket means when said bracket means is free to pivot for providing said predetermined tension of said belt;

freeing the pivot action of said bracket means by unclamping said clamping means, to permit said spring means to exert said predetermined tension on said belt;

fixing the pivot action of said bracket means by setting said clamping means for maintaining said predetermined tension of said belt;

such that said predetermined tension of said belt is maintained without an undesired continual pressure on said belt by said spring means.

* * * * *